United States Patent [19]

Adolph et al.

[11] Patent Number: 4,465,906

[45] Date of Patent: Aug. 14, 1984

[54] LOW-LEAKAGE POT MAGNET SYSTEM FOR MOVING-COIL LOUDSPEAKERS

[75] Inventors: Kurt Adolph; Winfried Grimbach, both of Bonn, Fed. Rep. of Germany

[73] Assignee: Magnetfabrik Bonn GmbH Vormals Gewerkschaft Windhorst, Bonn am Rhein, Fed. Rep. of Germany

[21] Appl. No.: 425,376

[22] Filed: Sep. 28, 1982

[30] Foreign Application Priority Data

Dec. 17, 1981 [DE] Fed. Rep. of Germany ..... 3150041

[51] Int. Cl.[3] ..... H01F 7/00

[52] U.S. Cl. ..... 179/115.5 SF; 335/231; 179/119 R; 179/120

[58] Field of Search ..... 179/117, 119 R, 120, 179/115.5 PC, 115.5 R, 115.5 SF; 335/231, 301

[56] References Cited

U.S. PATENT DOCUMENTS

| | | | |
|---|---|---|---|
| 3,201,529 | 8/1965 | Surh | 179/115.5 ME |
| 3,407,371 | 10/1968 | Gosma | 335/231 |
| 3,665,352 | 5/1972 | Dietrich et al. | 335/231 |

FOREIGN PATENT DOCUMENTS

| | | | |
|---|---|---|---|
| 1114538 | 8/1960 | Fed. Rep. of Germany | 335/231 |
| 1489798 | 3/1965 | Fed. Rep. of Germany | 179/120 |
| 1271274 | 6/1968 | Fed. Rep. of Germany | 179/120 |
| 712222 | 8/1966 | Italy | 179/120 |
| 55-11829 | 9/1980 | Japan | 179/115.5 SF |

OTHER PUBLICATIONS

G. Hecht, K. Kolbe, "Low Stray-Field Speaker for TV Receivers", *Funkschau,* vol. 50, No. 6, (Mar. 1978), pp. 257-258.

*Primary Examiner*—A. D. Pellinen
*Assistant Examiner*—L. C. Schroeder
*Attorney, Agent, or Firm*—Fisher, Christen & Sabol

[57] ABSTRACT

A low-leakage pot magnet system for moving-coil loudspeakers having two permanent magnets of opposite polarity is accomplished by spacing the lower permanent magnet away from the bottom of the screen pot by an appropriate support which includes a disk or plate of nonmagnetic material arranged between the lower permanent magnet body and the bottom of the screen pot.

9 Claims, 3 Drawing Figures

FIG.1
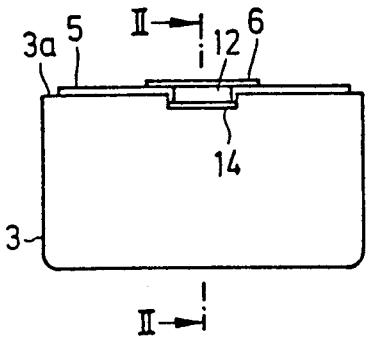
FIG.2
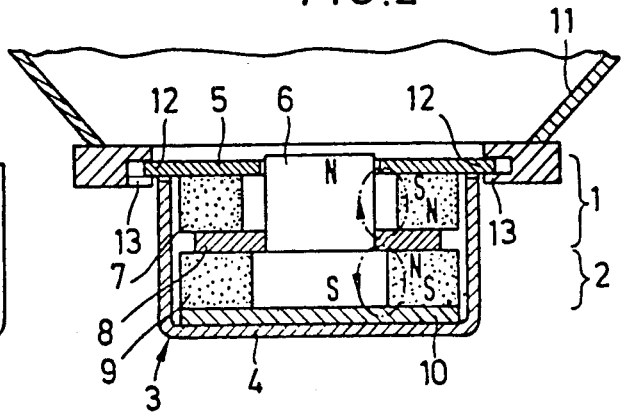
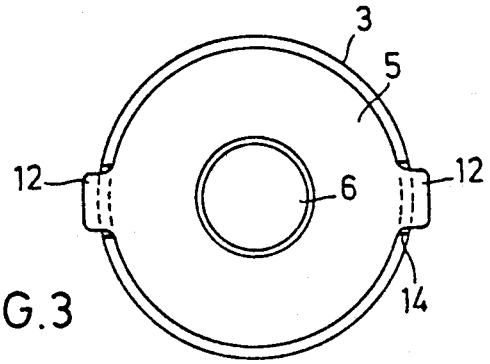
FIG.3

LOW-LEAKAGE POT MAGNET SYSTEM FOR MOVING-COIL LOUDSPEAKERS

BACKGROUND OF THE INVENTION

The present invention concerns a low-leakage pot magnet sytem for moving-coil loudspeakers.

In such low-leakage magnet systems, which are especially suitable for use in television sets or in the vicinity of ferrite antennae, the magnetic leakage field at 100 mm distance from the center of the pole core or from the bottom of the screen pot is less than 1 A/cm, while barium ferrite and AlNiCo systems of equal size have leakage fields on the order of 5 A/cm.

Due to the high price of such sytems, numerous attempts have been made to reduce the external leakage through less expensive measures. In one embodiment, for example, the loudspeaker magnet enclosure, or pot, made of iron is extended downwardly and the magnet system is inserted into it. The screening effect is, however, not very strong. A design in which the magnet system is located within the diaphragm cone itself is more effective. This design has the additional advantage of small overall height. The manufactures of television sets occasionally compensate for the influence of the loudspeaker system by gluing small ferrite magnets to the picture tube itself. However, this requires an additional expenditure during the manufacturing process.

SUMMARY OF THE INVENTION

The present invention has an object of improving the low-leakage pot magnet system to such an effect that while maintaining the conventional magnet materials, an even smaller external leakage than in the prior-art low-leakage magnet systems is achieved with simple means without fundamental design modifications.

With reference to a magnet system in which an upper annular permanent magnet concentrially surrounds a central pole piece and is separated from a lower annular, or disk-shaped, permanent magnet of opposite polarity this object is accomplished by providing a magnetic air gap between the lower permanent magnet and the bottom of the pot enclosing the magnet system.

This may be accomplished in several ways such as by forming an inwardly directed protuberance, or an annular inwardly directed rib, in the cylindrical wall of the pot which spaces the lower magnet away from the bottom wall, or the lowermost part of the pot may be filled with a spacer, such as a disk or plate made of a non-magnetic material, such as cardboard, plastic, brass, etc.

Even though such a disk or plate made of nonmagnetic material should have practically no influence on the external magnetic leakage of such magnet systems, it has been surprisingly found that an unexpectedly great improvement of the screening effect is achieved by the use of such disks or plates. It was thus determined that the magnetic leakage field at 100 mm distance from the bottom of the screen pot was only on the order of 0.2 A/cm.

Since the disk or plate made of nonmagnetic material is inside the screen pot, without causing any change in the external shape and dimensions of the screen pot, a very simple and cost-saving attachment of the system to the diaphragm support of the loudspeaker can be achieved which contributes significantly to the reduction of the external leakage toward the diaphragm support.

Further details and advantages of the present invention appear from the following description of a preferred embodiment shown schematically in the drawing.

BRIEF DESCRIPTION OF THE DRAWINGS

FIG. 1 shows a side elevational of a low-leakage pot magnet system,

FIG. 2 shows a vertical section through the magnet system according to the line II—II in FIG. 1 and, FIG. 3 shows a plan view of the pot magnet system of FIGS. 1 and 2.

DETAILED DESCRIPTION OF THE INVENTION

The low-leakage pot magnet system for moving-coil loudspeakers has two permanent magnet systems 1, 2, of opposite polarity, which are arranged in a fully closed screen pot 3 made of ferromagnetic material, such as soft iron, between the pot bottom 4 and the top plate 5 concentrically to the pole core 6 and coaxially one behind the other. The annular permanent magnet body 7 of the top permanent magnet system 1 surrounds the pole core 6 at a concentric distance from it and is screened by a lower pole plate 8 against the annular or disk-shaped permanent magnet body 9 of opposite polarity of the lower magnet system 2.

In a magnetic system of this type the magnet bodies 7 and 9 are axially polarized but the pole piece 5 and the upper end of core pole 6 are radially polarized with respect to each other to produce radial lines of force acting on the voice coil (not shown).

A disk or plate 10 made of nonmagnetic material, such as cardboard, plastic, brass, etc., which acts as an air gap, through which the leakage effect of the magnet system, measured at a distance of 100 mm from the bottom 4 of the screen pot 3 amounts to only about 0.2 A/cm, is arranged between the permanent magnet body 9 of the lower magnet system 2 and the bottom 4 of the screen pot 3.

The disk or plate 10 acts to space the magnet body 9 away from the ferromagnetic bottom wall 4 to create the above-mentioned air gap, which creates a discontinuity in the magnetic circuit which includes the lower end of pole core 6, lower pole plate 8, lower magnet body 9, and bottom wall 4. The pole core 6 does not extend below pole plate 8 and lower magnet body may therefore be formed in the shape of a plate, if desired.

The spacer 10 could be ring-shaped or formed in the shape of a cross, so long as it is made of non-magnetic material and, by forming the cylindrical wall of the screen pot 3 with an inwardly directed protuberance which engages the lower surface of magnet body 9 to limit the depth of its insertion into the screen pot 3, the spacer could be eliminated.

To simplify the fastening of the magnet system to the conial diaphragm support 11, the top plate 5 has lobes or projections 12 directed radially outward for a bayonet fastening of the magnet system to the hooks 13 which project downward from the diaphragm support 11 of the loudspeaker. Since the top plate 5 extends over the top edge 3*a* of the screen pot 3 only over part of its thickness, projections 12 project to the outside through peripheral recesses 14 at the edge of the screen pot 3.

I claim:

1. In a low-leakage pot magnet system for moving-coil loudspeakers of the type wherein two permanent magnet systems of opposite polarity are arranged, one above the other, within a screen pot enclosure made of a ferromagnetic material such as soft iron, the upper magnet system comprising an annular permanent magnet body concentrically surrounding an axial pole core and including upper and lower radially extending pole plates, the lower magnet system comprising an annular, or disk-shaped, permanent magnet body of opposite polarity to that of the upper magnet system and separated therefrom by said lower pole plate, the improvement which comprises spacer means to position the lower magnet system axially away from the bottom of the screen pot enclosure.

2. Low-leakage pot magnet system according to claim 1, wherein said spacer means comprises an element made of nonmagnetic material disposed between said lower magnet system and the bottom of the screen pot.

3. Low-leakage pot magnet system according to claim 2, wherein the element comprising said spacer means is a plate or disk.

4. Low-leakage pot magnet system according to claim 2, wherein the element comprising said spacer means is ring-shaped.

5. Low-leakage pot magnet system according to any one of claims 2, 3 or 4 wherein said nonmagnetic material comprises cardboard, plastic or brass.

6. Low-leakage pot magnet system according to claim 1, wherein said spacer means comprises an inwardly directed protuberance formed in the cylindrical wall of the screen pot.

7. Low-leakage pot magnet system according to claim 6, wherein said protuberance extends in an annular direction along at least a portion of circumferance of said wall.

8. Low-leakage pot magnet system according to any one of claims 1, 2 or 3, wherein the upper pole plate of the upper magnet system includes at least two radially outwardly directed lobes for bayonet-type detachable supporting engagement of the pot magnet system with the diaphragm supporting mechanism of a loudspeaker.

9. Low-leakage pot magnet system according to claim 8, wherein said lobes project outwardly beyond the outer periphery of the cylindrical wall of said screen pot through complementary recesses provided in the upper margin thereof.

* * * * *